US008956253B2

(12) United States Patent
Chandless

(10) Patent No.: US 8,956,253 B2
(45) **Date of Patent: *Feb. 17, 2015**

(54) SPEED AND TRAJECTORY MODIFYING DEVICE FOR MOVING OBJECT

(76) Inventor: Steven Glen Chandless, San Mateo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/890,597

(22) Filed: Sep. 24, 2010

(65) Prior Publication Data

US 2011/0070978 A1 Mar. 24, 2011

Related U.S. Application Data

(60) Provisional application No. 61/277,390, filed on Sep. 24, 2009.

(51) Int. Cl.

| | |
|---|---|
| ***A63B 69/00*** | (2006.01) |
| ***A63B 43/00*** | (2006.01) |
| ***A63B 67/18*** | (2006.01) |
| *A63B 71/00* | (2006.01) |
| *A63B 21/008* | (2006.01) |

(52) U.S. Cl.

CPC ..... *A63B 69/0002* (2013.01); *A63B 43/007* (2013.01); *A63B 67/18* (2013.01); *A63B 69/0079* (2013.01); *A63B 21/0088* (2013.01); *A63B 2043/001* (2013.01)

USPC ..... 473/423; 473/422; 473/425; 473/430

(58) Field of Classification Search

USPC ..... 473/422, 423, 226, 256, 228, 219, 229, 473/247, 431, 613, 437, 457; 482/111, 112, 482/148, 59, 74, 109; 244/155 A, 153 R

See application file for complete search history.

(56) References Cited

U.S. PATENT DOCUMENTS

| | | | | | |
|---|---|---|---|---|---|
| 1,419,682 | A | * | 6/1922 | Miles | 124/5 |
| 2,141,250 | A | * | 12/1938 | Perrault | 473/281 |
| 2,977,069 | A | * | 3/1961 | Huch et al. | 244/31 |
| 3,147,979 | A | * | 9/1964 | Wolfe | 473/281 |
| 3,416,803 | A | * | 12/1968 | Batista | 473/228 |
| 3,994,494 | A | * | 11/1976 | Kelley | 473/430 |
| 4,102,291 | A | * | 7/1978 | Sebald | 290/54 |
| 4,240,396 | A | * | 12/1980 | Randoll | 473/588 |
| 4,335,093 | A | * | 6/1982 | Salomon | 423/644 |

(Continued)

FOREIGN PATENT DOCUMENTS

| | | | | | |
|---|---|---|---|---|---|
| GB | 2098947 | A | * | 12/1982 | B63H 9/04 |
| GB | 2098948 | A | * | 12/1982 | B63H 9/04 |

(Continued)

*Primary Examiner* — Mitra Aryanpour

(74) *Attorney, Agent, or Firm* — GSS Law Group

(57) ABSTRACT

A ball travel-modifying device comprising a sail and a strikeable object modifies a travel distance and a rate of travel of a struck or thrown object and returns the strikeable object to an initial rest position after each hit or throw. The shape of the sail is triangular, quadrilateral, or other shapes and may be symmetric or asymmetric. The sail may be formed with a flat or curved surface and straight or curved edges. Multiple sails of the same or varying size and shape may be slidably adjusted along a suspension line. One or more apertures may be formed in the sail to modify a speed or a direction of a moving strikeable object. An adjustable aperture permits adaptation to various strikeable objects having a variety of sizes and weights or to cause a strikeable object to move in a preferred direction or with a preferred rate of travel.

28 Claims, 11 Drawing Sheets

(56) References Cited

U.S. PATENT DOCUMENTS

| | | | | | |
|---|---|---|---|---|---|
| 4,476,397 | A * | 10/1984 | Lawson | 290/54 |
| 5,184,825 | A * | 2/1993 | Ruth | 473/228 |
| 5,335,918 | A * | 8/1994 | Rupnik et al. | 473/228 |
| 5,362,059 | A * | 11/1994 | Grossman | 473/228 |
| 5,427,084 | A * | 6/1995 | Arnold et al. | 124/5 |
| 5,803,838 | A * | 9/1998 | DeMarini et al. | 473/437 |
| 7,188,808 | B1 * | 3/2007 | Olson | 244/153 R |
| 7,252,603 | B2 * | 8/2007 | Bove et al. | 473/426 |
| 7,275,719 | B2 * | 10/2007 | Olson | 244/155 A |
| 7,384,344 | B2 * | 6/2008 | Aguirre | 473/226 |
| 7,458,900 | B1 * | 12/2008 | Park | 473/437 |
| 7,704,169 | B1 * | 4/2010 | Bove et al. | 473/426 |
| 7,762,929 | B1 * | 7/2010 | Celone | 482/49 |
| 8,202,204 | B2 * | 6/2012 | Celone et al. | 482/111 |
| 2003/0207719 | A1 * | 11/2003 | Hughes | 473/228 |
| 2008/0242451 | A1 * | 10/2008 | Chandless | 473/423 |
| 2010/0319226 | A1 * | 12/2010 | Oral | 40/214 |
| 2011/0070978 | A1 * | 3/2011 | Chandless | 473/423 |

FOREIGN PATENT DOCUMENTS

| | | | | |
|---|---|---|---|---|
| GB | 2098949 | A * | 12/1982 | B63H 9/04 |
| GB | 2098950 | A * | 12/1982 | B63H 9/04 |
| GB | 2098951 | A * | 12/1982 | B63H 9/04 |
| GB | 2098952 | A * | 12/1982 | B63H 9/04 |
| GB | 2114948 | A * | 9/1983 | B63H 9/06 |

* cited by examiner

SPEED AND TRAJECTORY MODIFYING DEVICE FOR MOVING OBJECT

FIELD OF THE INVENTION

The present invention relates to a device to modify the speed and trajectory of a strikeable object after the object has been struck or thrown.

BACKGROUND

In sports such as baseball, softball, handball, golf, badminton, hockey, volleyball, football, field hockey and soccer, a player hits, kicks, or throws a strikeable object over a relatively long distance at relatively high speed. A strikeable object may be, but is not limited to, a ball, a shuttlecock, or a puck. The word "ball" will be used herein as an example of any such strikeable object. Many players of such sports practice to improve their strength and skill in controlling the speed and direction of the strikeable object. However, limitations in a practice area, such as limited space, safety hazards, or obstacles that would interfere with or be damaged by a moving strikeable object, may make it impractical to allow an object to travel freely after being struck or thrown. Furthermore, it is sometimes desirable to present a strikeable object to a player in a manner convenient for repetitive practice, exercise, or physical therapy. Also, some players practice alone for enjoyment, to warm up before a game, or when other players are not available.

Some devices use a net or cage to capture a struck or thrown object. Some devices have a strikeable object with a plurality of holes wherein air flowing through the holes reduces the speed and the distance traveled by the object. Other devices attach a parachute to a strikeable object to achieve similar results. In some devices, the speed of the strikeable object is reduced but the direction of travel is not modified, so the object may land in a location from which it cannot be easily or safely retrieved or the object may cause damage upon impacting another object. Other devices attach an elastic tether to a strikeable object to cause a struck or thrown object to return to the player. Some devices return the strikeable object to the player at a relatively high speed, which can be intimidating or unsafe for novice or young players. Some devices have limited portability or are difficult for young or inexperienced players to set up, and some devices are not suitable for indoor use.

SUMMARY

The present invention relates to a device to modify the travel of a strikeable object after the object has been struck or thrown. The invention includes a device comprising a strikeable object coupled to a sail. Alternatively, the invention includes a device comprising a strikeable object coupled to multiple sails. In some embodiments, the strikeable object is a ball. The sail is formed with three or more sides and has a shape and size to provide an effective amount of aerodynamic resistance to reduce the speed of a strikeable object placed in motion by a player. In some embodiments, the sail has a relatively large, flat surface. In other embodiments, the sail has a curved surface. The sail area may be symmetric or asymmetric relative to a reference line through the device. A strikeable object having at least one through-hole is adjustably coupled to the sail by a line passing slidably through the strikeable object and through a sleeve on the sail. Alternatively, the line is attached to the sail. In some embodiments, the strikeable object is detachable from the sail, enabling changes in the type of strikeable object used or replacement of a worn strikeable object.

A line connected to an end of a device built in accord with the invention permits attachment of the device to an external anchor. In some embodiments, the line is a suspension line that adjustably couples the strikeable object to the sail and adjustably couples the sail to the external anchor. In other embodiments, a first line is the suspension line and a second line is an adjustment line that adjustably couples the ball to the sail. The suspension line and adjustment line may be permanently attached to the sail or alternatively may be removably attached to the sail.

An external anchor may be a bracket, hook, clip, shackle, or similar connection hardware coupled to a wall, pole, support stand, beam, ceiling, fence, or similar stable structure, a hole formed in such a structure, or connection hardware coupled to a surface upon which the player stands, such as a stake driven into the ground or a shackle connected to a playing surface or to a heavy base such as a concrete block or heavy metal plate. Preferred external anchors will be displaced by a relatively small amount by a force from placing the strikeable object in motion or by a force from the object reaching a limit of its travel. An adjustable separation distance between the sail and the external anchor is set to a distance selected by the player. In some embodiments, the player may set an adjustable separation distance between the strikeable object and the sail or between the strikeable object and a surface upon which the player stands.

The sail is suspended at one end from an external anchor. The strikeable object is suspended from an opposite end of the sail. A distance measured from the external anchor to the strikeable object, plus an additional distance from material stretching, corresponds to a limit of travel for the strikeable object after the player sets the strikeable object in motion. After reaching the limit of travel, the strikeable object returns to the rest position and may be struck or thrown again.

A maximum speed of the strikeable object is reached shortly after the strikeable object is placed in motion and leaves the rest position. Thereafter, the speed of the moving strikeable object is reduced by aerodynamic resistance acting against a large surface of the sail, with lesser contributions to aerodynamic resistance from other parts of the embodiments of the invention. The sail is effective in reducing the speed of the strikeable object while the strikeable object and sail are moving together through the air. In some embodiments, the sail is formed with an aperture to alter the aerodynamic resistance of the sail. A size, shape, position, and number of apertures are selected to give an effective amount of aerodynamic resistance for a combination of size and weight of strikeable object. Alternatively, the sail has an aperture with an adjustable closure to permit a player to adapt the aerodynamic resistance of the sail to strikeable objects having a variety of sizes and weights. In some embodiments, an asymmetric sail affects the path of a moving strikeable object. In other embodiments multiple sails are used to alter the aerodynamic resistance of the device. The number of sails and the size, shape, configuration and position of each sail are selected to give an effective amount of aerodynamic resistance for a combination of weight of strikeable object and desired speed of travel of strikeable object after being struck or thrown. Alternatively, one or more multiple sails are adjustably positioned on the device to permit altering aerodynamic resistance of the device. In some multiple sail embodiments one or more overhanging sails alter the aerodynamic resistance of the device. The overhanging sail is effective in providing greater aerodynamic resistance as the strikeable object and sails are moving together through the air in one direction and then providing lesser aerodynamic resistance as the strikeable object and sails are moving together through the air in an opposite direction.

This section summarizes some features of the present embodiment. These and other features, aspects, and advantages of the embodiments of the invention will become better understood with regard to the following description and upon reference to the following drawings, wherein:

DESCRIPTION

Embodiments of the invention include a device intended to modify the travel of a strikeable object after the strikeable object has been struck or thrown. Devices built in accord with the invention are particularly suited for use with various kinds of balls, and the example embodiments below will be described using a ball as the strikeable object. Some of the benefits of the embodiments of the invention include, but are not limited to, portability, safety, ease of set-up by young or inexperienced players, return of the ball to its initial rest position after being struck or thrown, suitability for use indoors or outdoors, suitability for unsupervised individual practice, adjustable separation of the sail and the external anchor, adjustable separation of the sails relative to each other, adjustable separation of the ball relative to the sail or relative to a surface upon which a player stands to accommodate players of different sizes or different preferred practice motions, and detachable coupling of the ball to the sail to enable use of different types of balls or replacement of a worn ball. Other benefits include use as an aid to improve a player's strength and coordination, development of muscle memory, and use as a physical therapy device.

Figure 1:
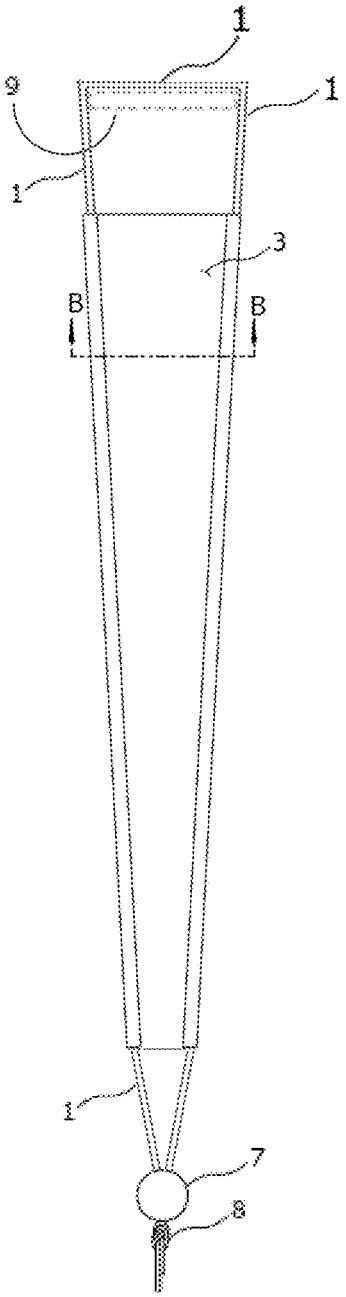
FIG. 1 is a front view of an embodiment of the invention.
Figure 2:
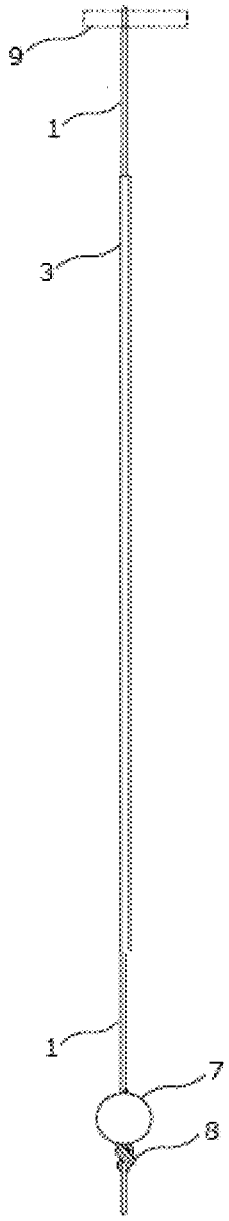
FIG. 2 is a side view of the embodiment of FIG. 1.
Figure 3A:
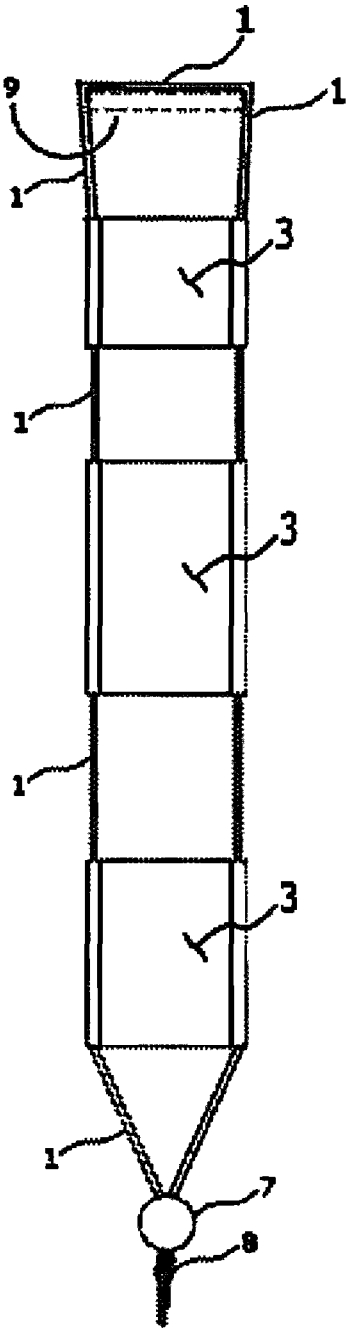
FIG. 3A is a front view of an embodiment of the invention having multiple sails.
Figure 3B:
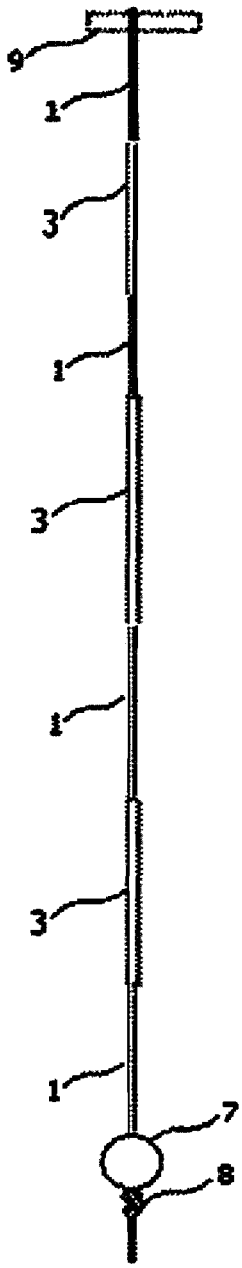
FIG. 3B is a side view of the embodiment of FIG. 3A.
Figure 4A:
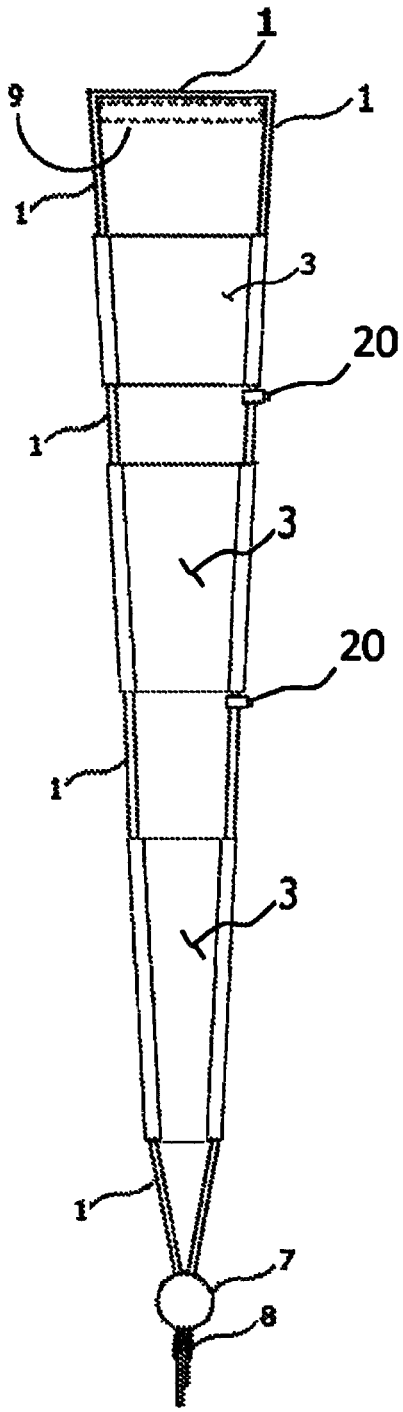
FIG. 4A is a front view of an embodiment of the invention having multiple adjustable sails.
Figure 4B:
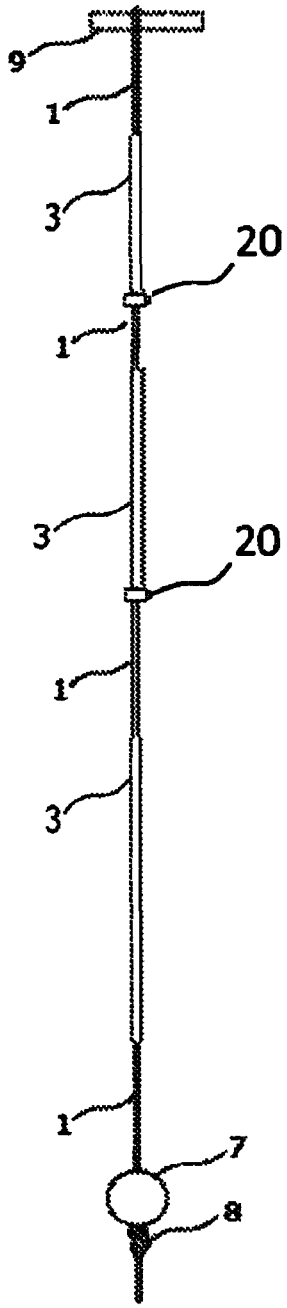
FIG. 4B is a side view of the embodiment of FIG. 4A.
Figure 10:
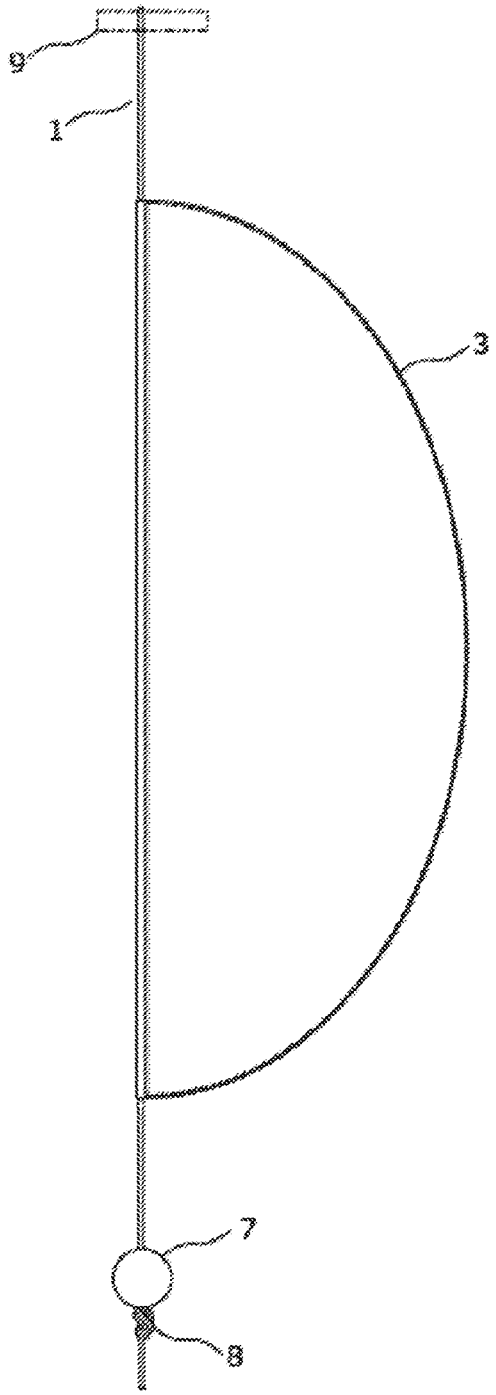
FIG. 10 is a side view of an embodiment having a sail with a curved surface.
Figure 17A:
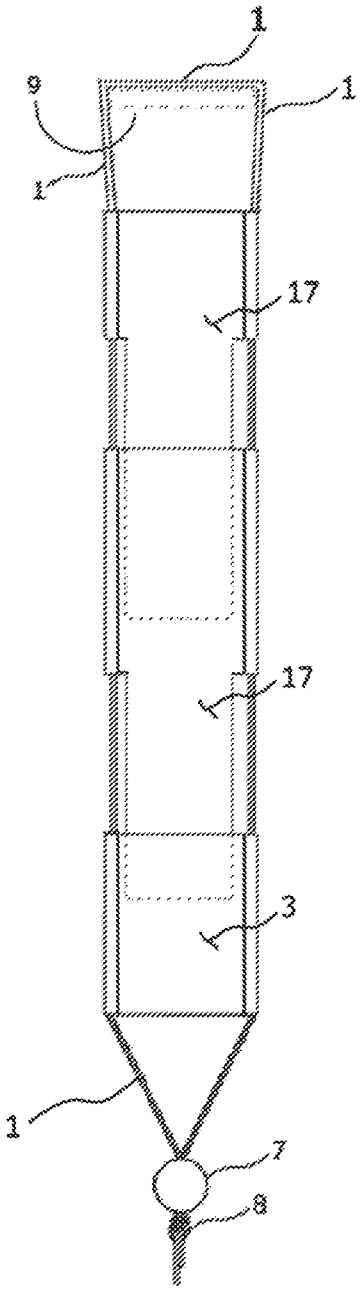
FIG. 17A is a front view of an embodiment of the invention having multiple overhanging sails.
Figure 17B:
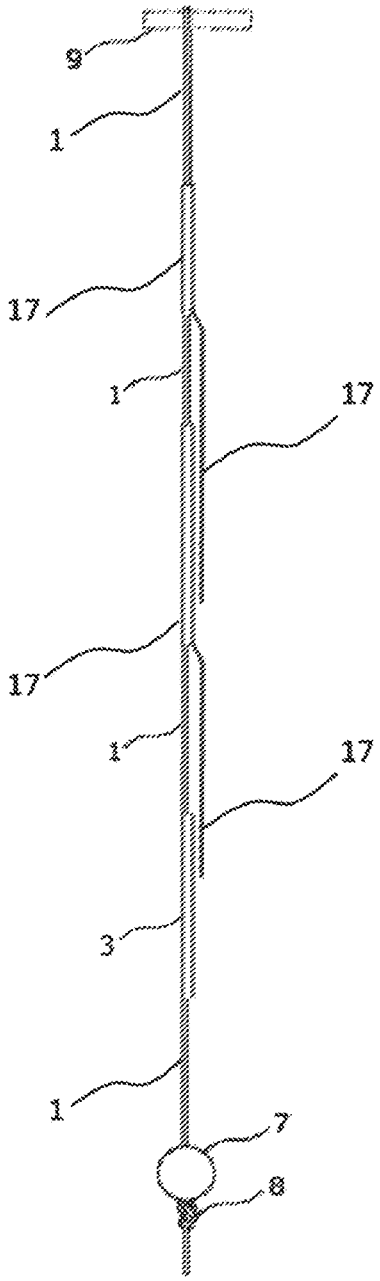
FIG. 17B is a side view of the embodiment of FIG. 17A.
Figure 17C:
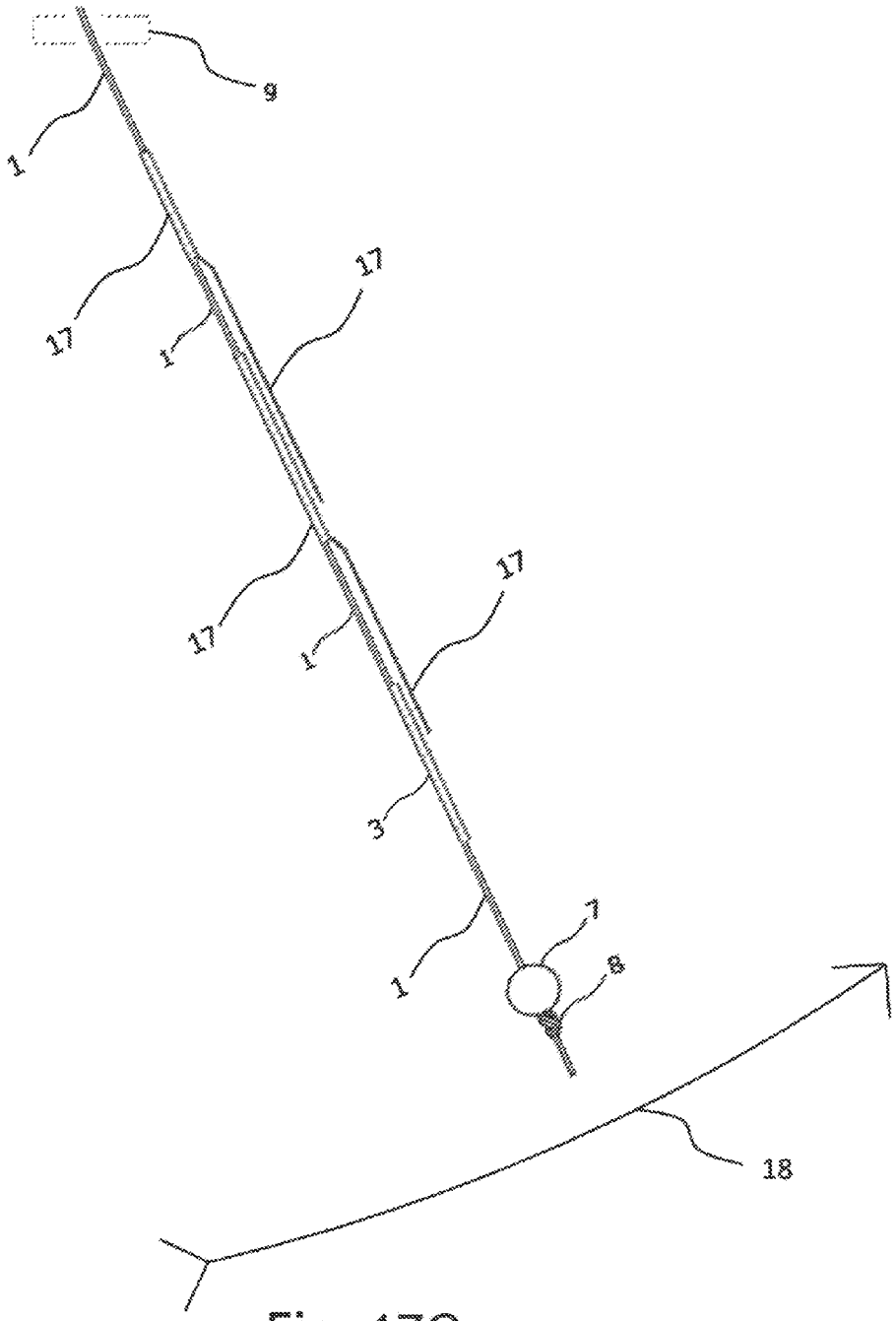
FIG. 17C is a side view of the embodiment of FIG. 17A while in motion in a direction providing greater aerodynamic resistance due to the incorporation of overhanging sails.
Figure 17D:
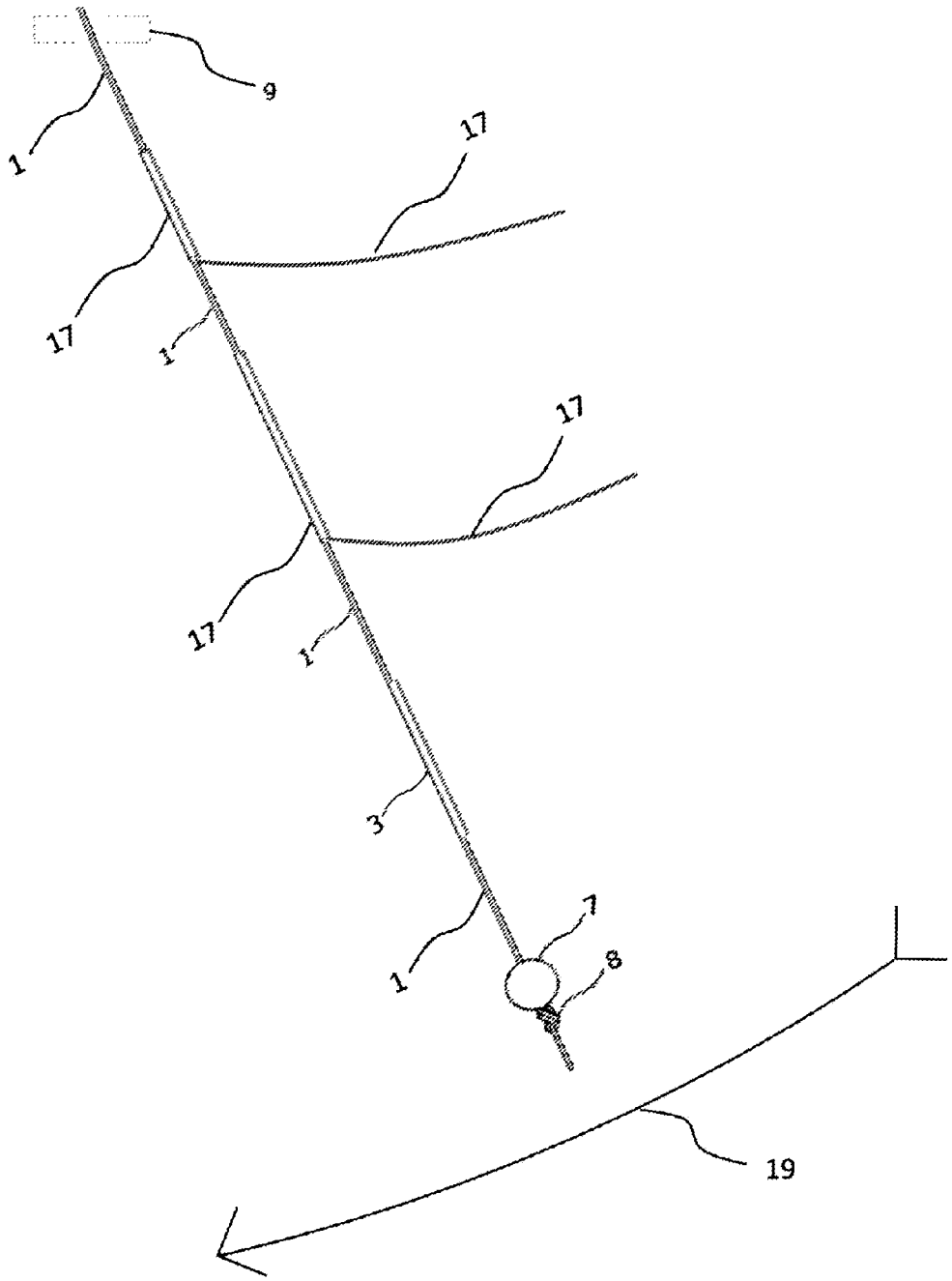
FIG. 17D is a side view of the embodiment of FIG. 17A while in motion in an opposite direction to that illustrated in FIG. 17C providing lesser aerodynamic resistance due to the incorporation of overhanging sails.

An embodiment of the invention illustrated in FIG. 1 and FIG. 2 comprises a ball 7 coupled to a sail 3 with a suspension line 1. Aerodynamic resistance from the motion of the sail 3 through air reduces the speed of the ball 7 coupled to the sail 3. Other parts of the embodiments of the invention may also contribute to aerodynamic resistance. As shown in the side view of FIG. 2, the sail 3 is flat. Alternatively, the sail 3 may be shaped into a surface having a smooth curve or a surface with folds or wrinkles to provide differing amounts of aerodynamic resistance compared to a flat sail. A side view of an embodiment having a curved sail 3 appears in FIG. 10. The sail 3 in FIG. 10 is shown in a distended position. Curved shapes other than the one shown in FIG. 10 may be used. An alternative embodiment of the invention is illustrated in FIG. 3A and FIG. 3B and comprises a ball 7 coupled to multiple sails 3 with a suspension line 1. Sail configurations other than the one shown in FIG. 3A may be used. An alternative embodiment of the invention is illustrated in FIG. 4A and FIG. 4B and comprises a ball 7 coupled to multiple sails 3 with a suspension line 1, and adjustable sail restraints 20 to adjust the position of the sails. Sail positions and configurations other than that shown in FIG. 4A may be used. An alternative multiple sail embodiment of the invention is illustrated in FIG. 17A, FIG. 17A, FIG. 17B, FIG. 17C and FIG. 17D and comprises a ball 7 coupled to multiple sails in which two are overhanging sails 17. In FIG. 17C a direction of travel 18 is shown to illustrate the aerodynamic resistance created by overhanging sails 17 of the embodiment shown in FIG. 17B while the device travels in direction of travel 18. In FIG. 17C overhanging sails 17 are shown against the device to properly reflect the greater aerodynamic resistance of overhanging sails when the device moves in direction of travel 18. In FIG. 17D an opposite direction of travel 19 is shown to illustrate the aerodynamic resistance created by overhanging sails 17 of the embodiment shown in FIG. 17B while the device travels in an opposite direction of travel 19 to that shown in FIG. 17C. In FIG. 17D overhanging sails 17 are shown fluttering away from the device to properly reflect the lesser aerodynamic resistance of overhanging sails when the device moves in direction of travel 19.

Figure 11:
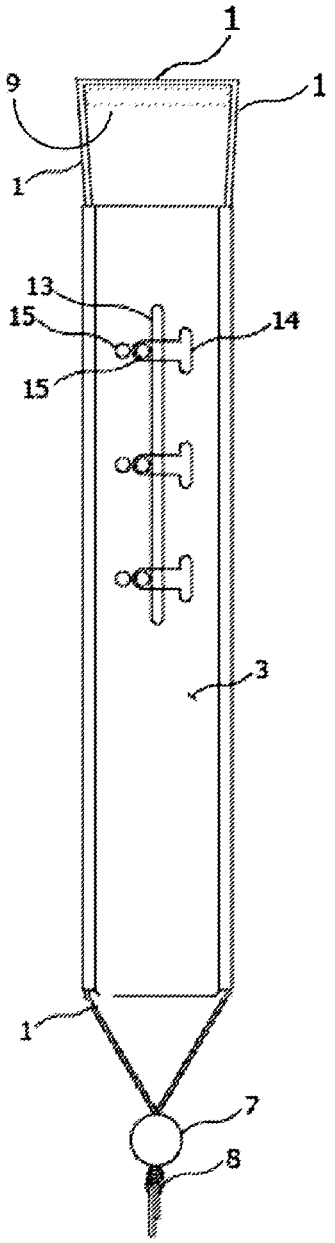
FIG. 11 is a front view of an embodiment having a rectangular sail, an aperture through the sail, an adjustable closure, and a closure fastener.
Figure 12:
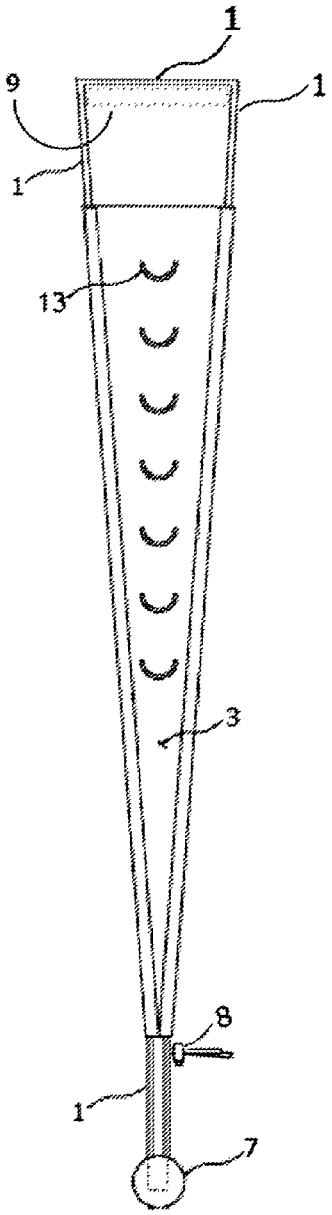
FIG. 12 is a front view of an embodiment having a triangular sail and a plurality of apertures through the sail and an adjustable suspension line which does not pass all the way through the ball.
Figure 13:
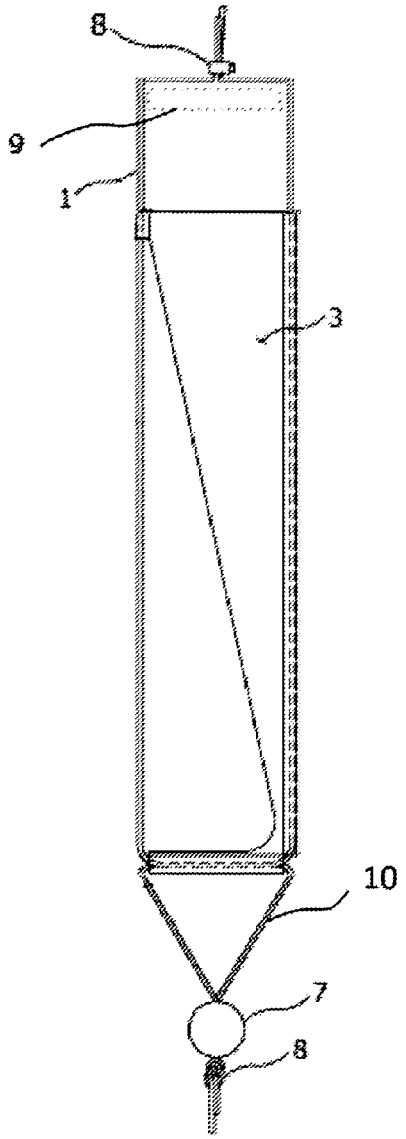
FIG. 13 is a front view of an embodiment having an asymmetric sail, a suspension line, and an adjustment line.

Alternative sail shapes include, but are not limited to, triangular, rectangular, or cross shape. The sail may be formed with more sail area on one side of a central axis of the embodiment than the other side of the central axis and is referred to herein as an asymmetric sail. In some embodiments an asymmetric sail causes a moving ball to travel on a preferred path. In the embodiment shown in FIG. 1, the sail 3 is quadrilateral. FIG. 11 shows a sail having a rectangular shape. A sail having a triangular shape is shown in FIG. 12. An asymmetric sail is shown in FIG. 13. The sail 3 may alternatively be formed with a straight edge or a curved edge. In an example of an embodiment having a ball 7 the size and weight of a baseball, the sail of FIG. 1 has a width of approximately 8 inches (20 cm) near the top, a width of approximately 4 inches (10 cm) near the bottom, and a length of approximately 50 to 60 inches (127 to 152 cm), but other dimensions may also be used.

The material of the sail 3 is chosen for strength, flexibility, resistance to damage from abrasion, sunlight, and moisture, light weight, and ease of forming into a desired shape. Examples of sail materials include, but are not limited to, woven fabric made from cotton, nylon, or polyester, blends that include these materials, fabrics made from these materials having an open weave to permit air to flow through holes in the weave, and nonwoven materials such as polyester formed into thin, strong, flexible sheets. The sail may alternatively be formed from a stiff or flexible material. In a multiple sail embodiment all of the sails may be made from the same material; alternatively all of the sails may not be made from the same material.

In embodiments of the invention wherein a portion of the sail 3 is free to slide along the suspension line 1 and wherein the material of the sail is sufficiently flexible, a length of the sail 3 may be adjusted by sliding an end of the sail toward the opposite end. The resulting shortened and folded or wrinkled sail will have a different amount of aerodynamic resistance compared to a sail stretched to its full length. Such a change in the length of the sail 3 may be made to affect a rate or direction of travel by a struck or thrown ball 7 or other strikeable object coupled to the embodiment. In embodiments of the invention as illustrated in FIG. 4A and FIG. 4B wherein the entire sail 3 is free to slide along the suspension line 1 and wherein the sail position is determined by the location of adjustable sail restraint 20 on suspension line 1, sail 3 may be repositioned along suspension line 1 by sliding adjustable sail restraint 20 along the suspension line. The repositioned sail 3 modifies the speed and trajectory of strikeable object 7 after being struck compared to the speed and trajectory of strikeable object 7 after being struck wherein the sail 3 was in the original position. The adjustable sail restraint 20 may be a clip, line toggle, cord lock, ferrule, or clamp. An embodiment having two adjustable sail restraints 20 comprising a cord lock coupled to the suspension line 1 is shown in FIG. 4A and FIG. 4B.

Figure 5:
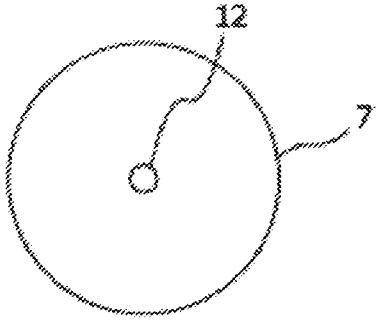
FIG. 5 is a top view of an example of a ball having a through-hole.
Figure 6:
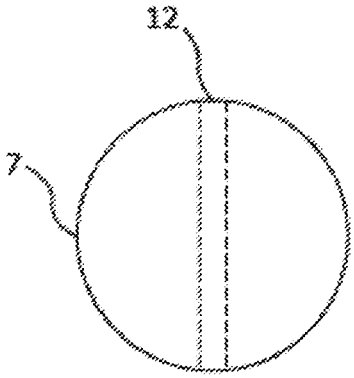
FIG. 6 is a front view of the ball of FIG. 5.
Figure 7:
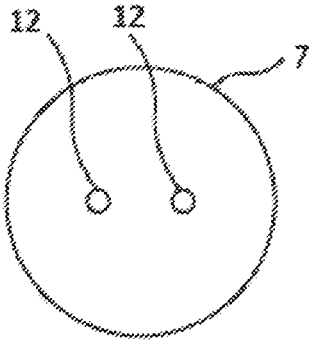
FIG. 7 is a top view of an example of a ball having two through-holes.
Figure 8:
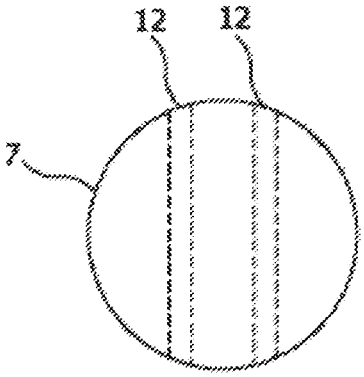
FIG. 8 is a front view of the ball of FIG. 7.
Figure 15:
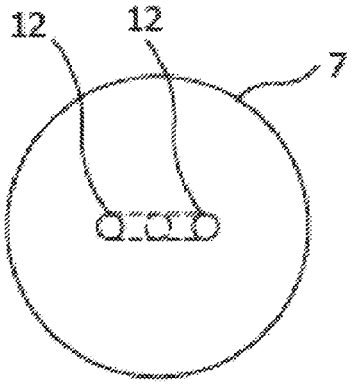
FIG. 15 is a top view of an example of a ball having two intersecting through-holes.
Figure 16:
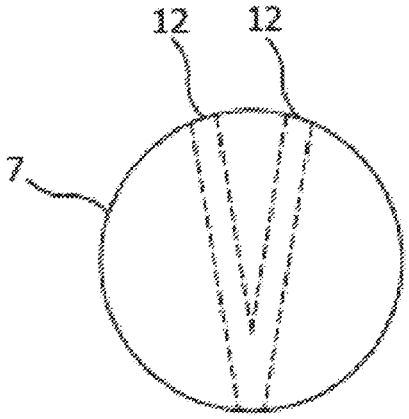
FIG. 16 is a front view of the ball of FIG. 15.

The embodiment of FIG. 1 includes the ball 7. A top view of the ball 7 is shown in FIG. 5 and a front view is shown in FIG. 6. The ball 7 is provided with a through-hole 12 having a diameter sufficiently large to admit two strands of line. Another embodiment of the ball 7 with two through-holes is shown in FIG. 7 in a top view and FIG. 8 in a front view, with each through-hole 12 sized to admit a single strand of line. A long axis of a through-hole 12 may alternatively be parallel to an axis through the center of the ball or not parallel to an axis through the center of the ball. FIG. 15 shows a top view of a ball having a first through-hole 12 which intersects a second through-hole 12. A front view of the ball of FIG. 15 is shown in FIG. 16.

In the embodiment shown in FIG. 1 and FIG. 5, the sail 3, and ball 7 are coupled together by a suspension line 1. An end of the suspension line 1 is passed through a hole 12 in the ball 7, through a sleeve along a first side of the sail 3, through a sleeve along a second side of the sail 3, and back through the hole 12 in the ball 7.

In other embodiments, a line for coupling the ball 7 to the sail 3 is an adjustment line 10, a separate line from the suspension line 1. An embodiment having an adjustment line 10 and a suspension line 1 is shown in FIG. 13. In some embodiments with an adjustment line 10, the adjustment line 10 or the ball 7, or both, are detachable. In embodiments with a suspension line 1 and an adjustment line 10, the two lines may pass through the same sleeve in the sail as shown in FIG. 13, or the suspension line 1 may pass through a sleeve at one end of the sail and the adjustment line 10 may pass through a sleeve at an opposite end of the sail.

Figure 9:
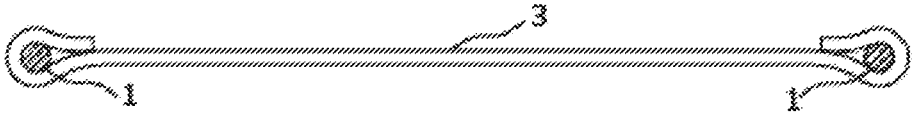
FIG. 9 is an enlarged section of the sail showing a suspension line in a sleeve on the sail. The viewing direction for FIG. 9 is shown by a line B-B in FIG. 1.

An enlarged cross section in FIG. 9 shows the suspension line 1 inside sleeves along the sides of the sail 3. The viewing direction for FIG. 9 is shown by a line B-B in FIG. 1. For embodiments having a suspension line 1 and an adjustment line 10 in separate sleeves, the sail 3 may be formed without sleeves along the sides, or the sleeves may contain a stiff rod, wire, or bar with or instead of a suspension line 1. A sufficient amount of slack is provided in the suspension line 1 to permit the embodiments of the invention to be suspended from an external anchor 9. The external anchor 9 is not a part of the embodiments described herein. The suspension line 1 remains hung or attached to the external anchor 9 while the embodiment is in use, but may be detached from the external anchor 9 to permit storage or use of an embodiment of the invention at another location.

As shown in FIG. 1, an adjustable line restraint 8 for setting an adjustable separation between the ball 7 and the lower end of the sail 3 comprises a knot formed in the suspension line 1 underneath and adjacent to the ball 7. In other embodiments, the adjustable line restraint 8 couples the ball 7 to the adjustment line 10, as shown in FIG. 13. The adjustable line restraint 8 may alternatively comprise a knot, clip, line toggle, cord lock, ferrule, or clamp. An embodiment having an adjustable line restraint 8 comprising a cord lock coupled to the suspension line 1 and another line restraint 8 comprising a cord lock coupled to the adjustment line 10 is shown in FIG. 13.

Figure 14:
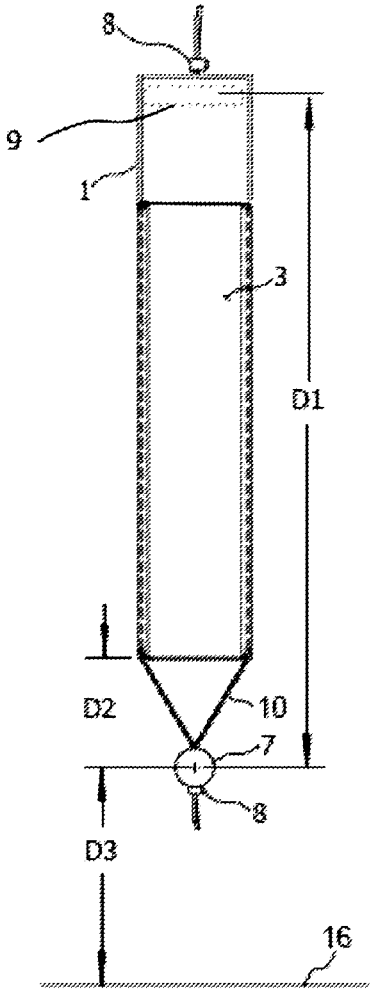
FIG. 14 is a front view of an embodiment having a suspension line and an adjustment line and showing adjustable separation distances D1, D2, and D3.

By positioning a first adjustable line restraint 8 on the suspension line 1 and a second adjustable line restraint 8 on the adjustment line 10, the position of the ball 7 may be adjusted to a preferred separation distance between the ball and the external anchor 9, as shown in FIG. 14 by the distance marked D1. A preferred separation distance between the ball 7 and the bottom end of the sail 3 may be set as shown by the distance marked D2 in FIG. 14. In an embodiment having a suspension line 1 but not an adjustment line 10, for example the embodiment of FIG. 1, separation distance D2 may not be set independently of separation distance D1. A preferred separation distance between the ball 7 and a surface upon which a person stands 16 may be set as shown by the distance marked D3 in FIG. 14. An example of a separation distance between the ball 7 and the lower end of the sail 3 is about two to three feet, but other separation distances may be used.

The material of the suspension line 1 and adjustment line 10 is chosen to be strong enough to withstand repeated impulse loads from striking or throwing the ball, have good abrasion resistance, and resist damage from sunlight and moisture. Examples materials include, but are not limited to, nylon, polyester, metal wire, blends of these materials with each other or with other materials, and lines formed from joined segments of these and other materials.

In some embodiments, the suspension line 1 is permanently attached by adhesive, fusing, or sewing to the sail 3, thereby preventing the sail 3 from slipping along the line.

The aerodynamic resistance generated by the sail 3 may be modified by forming an aperture in a large surface of the sail. Examples of embodiments having a sail 3 with an aperture 13 are shown in FIG. 11 and FIG. 12. In FIG. 11, an aperture 13 has the shape of a long slot. In FIG. 12, a plurality of apertures 13 each have the shape of a semicircular arc. Alternatively, a plurality of apertures having other shapes and sizes are formed in the sail 3. A size, shape, and number of apertures are selected to provide a preferred amount of aerodynamic resistance for a preferred size and weight of ball.

In the embodiment of FIG. 11, the aerodynamic resistance of the sail 3 is adjustable to accommodate a variety of balls having different sizes and weights. In FIG. 11, the aperture 13 is opened or closed by at least one adjustable closure 14. The adjustable closure 14 is attached to a surface of the sail and connects from a side of the aperture 13 to one or more closure fasteners 15 on an opposite side of the aperture 13, thereby permitting the aperture 13 to optionally be open, partially closed, or closed. Examples of closure fasteners 15 include, but are not limited to, snaps, ties, buttons, zippers, and hook-and-loop fasteners. In FIG. 4A the aerodynamic resistance of the invention is adjustable to accommodate a variety of preferred speeds of travel and trajectories of the strikeable object 7 after being struck or thrown. In FIG. 4A the adjustable sail restraint 20 is slid along the suspension line 1 to reposition sail 3.

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, or use of equivalent functional steps for steps described herein. Such insubstantial variations are to be considered within the scope of what is contemplated here. Moreover, if plural examples are given for specific means, or steps, and extrapolation between or beyond such given examples is obvious in view of the present disclosure, then the disclosure is to be deemed as effectively disclosing and thus covering at least such extrapolations.

Unless expressly stated otherwise herein, ordinary terms have their corresponding ordinary meanings within the respective contexts of their presentations, and ordinary terms of art have their corresponding regular meanings.

What is claimed is:

1. A device for modifying the travel of a strikeable object, comprising:

a suspension line configured for attaching said device to an external anchor;

a sail configured for producing variable aerodynamic resistance, said sail having a first end, a second end, a first side and a second side, said sail being connected to said suspension line; and a strikeable object coupled to said device below said sail;

wherein, when said strikeable object is in a rest position, said device is vertically suspended from the external anchor by said suspension line, with said strikeable object suspended below said sail;

wherein, when said strikeable object is caused to move in a first direction, a first aerodynamic resistance produced by said sail reduces the speed and distance traveled by said strikeable object;

and wherein, when said strikeable object reaches a limit of travel, said strikeable object returns to said rest position moving in a second, opposite direction due to a weight of said strikeable object, and a second aerodynamic resistance, different from said first aerodynamic resistance, produced by said sail reduces the speed of the return of said strikeable object to said rest position.

2. The device of claim 1, wherein said strikeable object is detachably coupled to said device.

3. The device of claim 2, further comprising a first separation distance between said second end of said sail and said strikeable object, wherein said first separation distance is adjustable.

4. The device of claim 3, further comprising a second separation distance between said strikeable object and a surface upon which a person stands, wherein said second separation distance is adjustable.

5. The device of claim 3, further comprising an adjustable line restraint, wherein a position of said adjustable line restraint corresponds to said separation distance between said second end of said sail and said strikeable object.

6. The device of claim 5, further comprising an adjustment line, wherein said adjustment line is detachably connected to said device and said adjustment line is detachably connected to said strikeable object.

7. The device of claim 6, wherein said adjustable line restraint is coupled to said adjustment line.

8. The device of claim 5, wherein said sail further comprises: a first sleeve formed in said sail on said first side; and a second sleeve formed in said sail on said second side, wherein said suspension line passes through said first and second sleeves.

9. The device of claim 8, wherein said sail has an asymmetric shape.

10. The device of claim 9, wherein said asymmetric shape causes said strikeable object to travel on a preferred path.

11. The device of claim 8, wherein said sail has a quadrilateral shape.

12. The device of claim 8, wherein said sail has a triangular shape.

13. The device of claim 8, wherein the strikeable object may be detached and replaced with a different strikeable object.

14. The device of claim 13, wherein the strikeable object is a ball.

15. The device of claim 13, wherein said sail further comprises: a front surface; and a back surface, wherein said sail is formed with an aperture passing from said front surface to said back surface.

16. The device of claim 15, further comprising a plurality of apertures passing from said front surface to said back surface.

17. The device of claim 15, further comprising an adjustable closure attached to said front surface of said sail, wherein said adjustable closure is adjusted to affect a rate of travel of said strikeable object.

18. The device of claim 1, wherein a plurality of sails are connected to said suspension line.

19. The device of claim 18, wherein at least one of said plurality of sails overhangs another of said plurality of sails.

20. The device of claim 8, wherein said sail is repositionable along said suspension line.

21. The device of claim 1, wherein said device comprises a plurality of sails, said plurality of sails configured to produce said first aerodynamic resistance when said plurality of sails moves in said first direction of travel and to produce said second aerodynamic resistance, which is different from said first aerodynamic resistance, when said plurality of sails moves in said second, opposite direction of travel.

22. The device of claim 1, wherein said second aerodynamic resistance is greater than said first aerodynamic resistance.

23. The device of claim 1, further comprising a structure on said device adjacent to said sails wherein said sail is configured to overhang said structure on said device; and wherein, when said sail moves in said first direction of travel, said sail flutters away from said structure and said sail produces said first aerodynamic resistance; and wherein, when said sail moves in said second direction of travel, said structure prevents said sail from fluttering away from said structure and said sail produces said second aerodynamic resistance; and wherein said second aerodynamic resistance is greater than said first aerodynamic resistance.

24. The device of claim 23, wherein said structure is another sail connected to said suspension line.

25. The device of claim 1, wherein said first aerodynamic resistance is greater than said second aerodynamic resistance.

26. A device attached to an anchor for modifying the travel of a strikeable object, comprising:

a suspension line, wherein said suspension line is attached to the anchor;

a first sail having a first end, a second end, a first side and a second side, wherein said first sail is connected to said suspension line;

a second sail having a first end, a second end, a first side and a second side, wherein said second sail is connected to said suspension line;

a strikeable object coupled to said device below said first sail and said second sail, wherein said strikeable object is selected from the group consisting of: a ball, a shuttlecock and a puck;

a first structure on said device adjacent to said first sail and a second structure on said device adjacent to said second sail; wherein said first sail is configured to overhang said first structure on said device and said second sail is configured to overhang said second structure on said device; and wherein, when said device moves in a first direction of travel, said first sail and said second sail flutter away from said first and second structures and said first sail and said second sail produce a first aerodynamic resistance; and wherein, when said device moves in a second, opposite direction of travel, said first and second structures prevent said first sail and said second sail from fluttering away from said first and second structures and said sail produces a second aerodynamic resistance; and wherein said second aerodynamic resistance is different from said first aerodynamic resistance.

27. The device of claim 26, wherein said first aerodynamic resistance is greater than said second aerodynamic resistance.

28. The device of claim 26, wherein said second aerodynamic resistance is greater than said first aerodynamic resistance.

* * * * *